US009617044B2

(12) United States Patent
Murphy et al.

(10) Patent No.: US 9,617,044 B2
(45) Date of Patent: Apr. 11, 2017

(54) FLUID CONTAINER SHIP CAP

(71) Applicant: Hewlett-Packard Development Company, L.P., Houston, TX (US)

(72) Inventors: Bryan Murphy, Lucan (IE); Jon Rittgers, Celbridge (IE); Odhran Hendley, Bray (IE); Michael Mulloy, Dublin (IE); Eduardo Macias, Clonee (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 60 days.

(21) Appl. No.: 14/428,422

(22) PCT Filed: Oct. 26, 2012

(86) PCT No.: PCT/US2012/062311

§ 371 (c)(1),
(2) Date: Mar. 16, 2015

(87) PCT Pub. No.: WO2014/065829

PCT Pub. Date: May 1, 2014

(65) Prior Publication Data

US 2015/0329248 A1 Nov. 19, 2015

(51) Int. Cl.

| | |
|---|---|
| ***B41J 2/15*** | (2006.01) |
| ***B65D 41/32*** | (2006.01) |
| ***B41J 2/175*** | (2006.01) |

(52) U.S. Cl.

CPC ..... *B65D 41/32* (2013.01); *B41J 2/17533* (2013.01); *B41J 2/17553* (2013.01); *B41J 2/17559* (2013.01); *Y10T 29/49819* (2015.01); *Y10T 29/49824* (2015.01)

(58) Field of Classification Search

CPC ..... B41J 2/175; B41J 2/1752; B41J 2/17553; B41J 2/17509; B41J 2202/20; B41J 29/13; B41J 2/17503

See application file for complete search history.

(56) References Cited

U.S. PATENT DOCUMENTS

| | | | | |
|---|---|---|---|---|
| 6,033,063 | A | 3/2000 | Tomikawa et al. | |
| 6,062,390 | A | 5/2000 | Nakamura | |
| 6,216,906 | B1 * | 4/2001 | Koshikawa | B41J 2/16505 220/359.2 |
| 6,776,477 | B2 | 8/2004 | Putman et al. | |

(Continued)

FOREIGN PATENT DOCUMENTS

| | | |
|---|---|---|
| EP | 1658981 | 5/2006 |
| WO | WO-2009142617 | 11/2009 |
| WO | WO-2009145770 | 12/2009 |

*Primary Examiner* — Lamson Nguyen

(74) *Attorney, Agent, or Firm* — Law Firm of Timothy Myers

(57) ABSTRACT

A fluid container ship cap seals a plurality of fluid interconnects of a fluid container during one or both of shipping and storage. The fluid container ship cap includes an elastomeric seal having a plurality of fluidic sealing members to seal a corresponding plurality of fluid interconnects. The fluid container ship cap further includes a rigid shell to rotate the fluid container ship cap about an axis of rotation at a fulcrum provided by a first fluidic sealing member of the plurality of fluidic sealing members. The elastomeric seal is affixed to the rigid shell.

14 Claims, 4 Drawing Sheets

(56) References Cited

U.S. PATENT DOCUMENTS

| | | | | |
|---|---|---|---|---|
| 6,916,085 | B2 | 7/2005 | Kotaki et al. | |
| 6,916,088 | B2 | 7/2005 | Smith et al. | |
| 7,322,670 | B2 * | 1/2008 | Hayashi | B41J 2/16508 347/22 |
| 7,527,366 | B2 | 5/2009 | Jones et al. | |
| 7,891,790 | B2 | 2/2011 | Nip | |
| 9,061,512 | B2 * | 6/2015 | Nozawa | B41J 2/17503 347/49 |

* cited by examiner

FLUID CONTAINER SHIP CAP

CROSS-REFERENCE TO RELATED APPLICATIONS

N/A

STATEMENT REGARDING FEDERALLY SPONSORED RESEARCH OR DEVELOPMENT

N/A

BACKGROUND

Fluids are often packaged in a container for delivery to a user. The packaged fluids in the container may be shipped from a manufacturing facility to a warehouse for storage. After some time in storage, the packaged fluids may be taken out of storage and used. When taken out of storage, the container must generally be opened to enable the fluids to be extracted and employed.

For example, inks such as, but not limited to, inks used in inkjet printers, are often packaged in an ink cartridge adapted for use in an ink delivery system (e.g., inkjet printer). The ink cartridge may have a fluid interconnect that facilitates ink extraction by the ink delivery system. A ship cap may be used to seal the ink cartridge during one or both of shipping and storage. The ship cap is then removed (e.g., by an end user) to allow the ink to be extracted. As such, the ship cap must both provide at least a fluid tight seal to prevent leakage of the ink during shipping and storage and be readily removable to enable ink extraction by an end user.

BRIEF DESCRIPTION OF THE DRAWINGS

Various features of examples in accordance with the principles described herein may be more readily understood with reference to the following detailed description taken in conjunction with the accompanying drawings, where like reference numerals designate like structural elements, and in which.

Figure 1A:
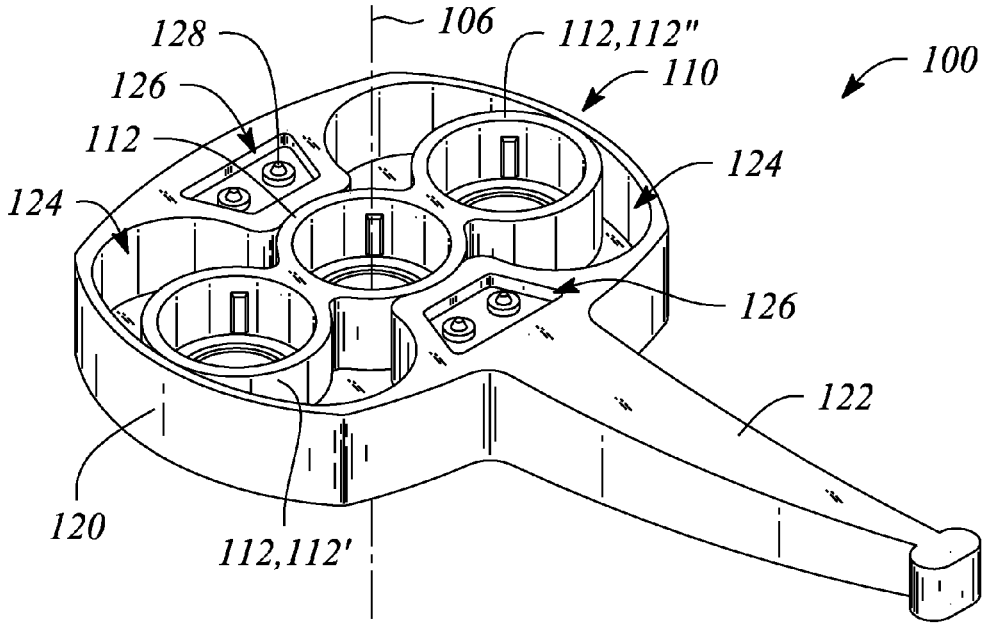
FIG. 1A illustrates a perspective view of a fluid container ship cap, according to an example consistent with the principles described herein.

Certain examples have other features that are one of in addition to and in lieu of the features illustrated in the above-referenced figures. These and other features are detailed below with reference to the above-referenced figures.

DETAILED DESCRIPTION

Examples in accordance with the principles described herein provide a ship cap to seal a fluid container during one or both of shipping and storage. In particular, the ship cap may provide one or both of a fluid tight and a gas tight seal of a plurality of fluid interconnects of the fluid container. The ship cap provides each of the fluid interconnects a separate seal, according to various examples. The fluid interconnects may be associated with separate reservoirs of the fluid container (e.g., when the fluid container is a ganged fluid container). The ship cap is readily removable from the fluid container by rotating the ship cap when the fluid container is to be placed into service. A handle that is part of a rigid shell of the ship cap is provided in various examples to allow for application of a torque to rotate the ship cap during removal, according to various examples.

A 'ganged' fluid container is defined herein to mean a fluid container comprising a plurality of separate reservoirs or cavities that are connected or 'ganged' together to form a single unit. As such, the ganged fluid container is a single container that has more than one reservoir for holding fluids, for example. Further, the ganged reservoirs are generally not in fluid contact with one another and thus provide separate storage in the single unit. As such, the ganged fluid container may provide a plurality of separate reservoirs for holding a similar plurality of separate fluids without allowing the separate fluids to mix within the ganged fluid container, according to various examples. For example, the separate fluids may be inks of different colors and the ganged fluid container may be configured to provide the different colored inks without mixing the colors.

Herein 'positive contact' between a pair of objects is defined as a contact provided by a positive pressure that is greater than zero exerted by a first object against a second object. In some examples, the positive contact may compress the first object to provide a seal between the objects. For example, the positive contact may compress a gasket or sealing member to provide a seal with a surface (e.g., a nozzle or rim of an orifice). As such, when the sealing member is pressed against the surface with sufficient force to serve as a seal, the sealing member is in positive contact with the surface, by definition herein.

Further, as used herein, the article 'a' is intended to have its ordinary meaning in the patent arts, namely 'one or more'. For example, 'a fluidic sealing member' means one or more fluidic sealing members and as such, 'the fluidic sealing member' means 'the fluidic sealing member(s)' herein. Also, any reference herein to 'top', 'bottom', 'upper', 'lower', 'up', 'down', 'front', back', 'left' or 'right' is not intended to be a limitation herein. Herein, the term 'about' when applied to a value generally means within the tolerance range of the equipment used to produce the value, or in some examples, means plus or minus 10%, or plus or minus 5%, or plus or minus 1%, unless otherwise expressly specified. Moreover, examples herein are intended to be illustrative only and are presented for discussion purposes and not by way of limitation.

Figure 1B:
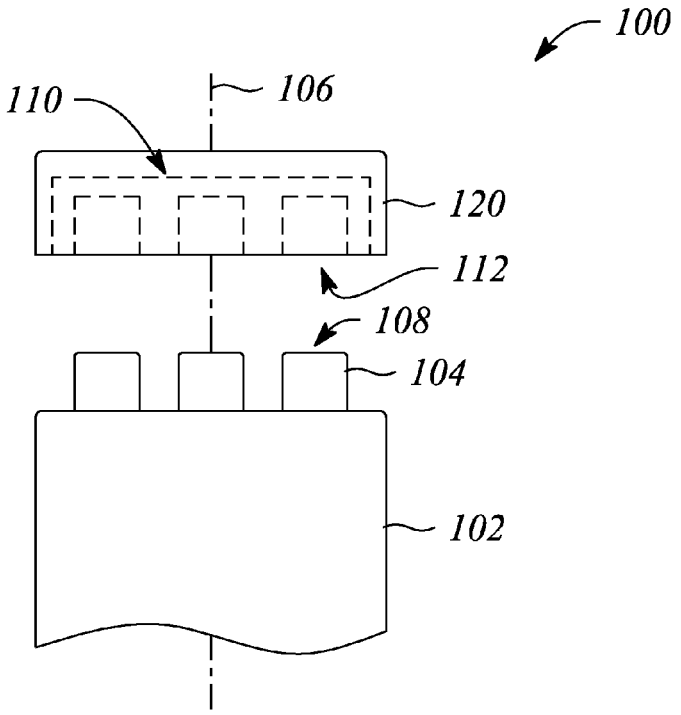
FIG. 1B illustrates an end view of the fluid container ship cap illustrated in FIG. 1A, according to an example consistent with the principles described herein.

FIG. 1A illustrates a perspective view of a fluid container ship cap 100, according to an example consistent with the principles described herein. In particular, a bottom or mating side of the fluid container ship cap 100 is illustrated in FIG. 1A. FIG. 1B illustrates an end view of the fluid container ship cap 100 illustrated in FIG. 1A, according to an example consistent with the principles described herein. FIG. 1B also illustrates an end view of a portion of a fluid container 102 having fluid interconnects 104. A dashed line 106 in FIGS. 1A and 1B indicates an axis of rotation of the fluid container ship cap 100.

As illustrated in FIG. 1A, the fluid container ship cap 100 comprises an elastomeric seal 110. The elastomeric seal 110 comprises a plurality of fluidic sealing members 112. The fluidic sealing members 112 are configured to seal a corresponding plurality of fluid interconnects of a fluid container. For example, the fluidic sealing members 112 may be configured to seal the fluid interconnects 104 of the fluid container 102 illustrated in FIG. 1B. In particular, the elastomeric seal 110 illustrated in FIG. 1A comprises three sealing members 112 to seal the three corresponding fluid interconnects 104 of the fluid container 102 (e.g., illustrated in FIG. 1B), for example. The elastomeric seal 110 is illustrated as a hidden line (i.e., dashed line) in FIG. 1B to depict the correspondence between the sealing members 112 and fluid interconnects 104. In some examples, the three fluid interconnects 104 may be associated with three separate cavities of the fluid container 102. Each cavity may be configured to contain a separate fluid (e.g., different colored inks), for example. In other examples (not illustrated), the elastomeric seal 110 may comprise two fluidic sealing members 112, while in yet other examples the elastomeric seal 110 may comprise more than three fluidic sealing members 112 (e.g., four, five, six, etc.).

According to some examples, the ship cap 100 is configured to be mated to the ganged fluid container 102 wherein the fluidic sealing members 112 seal the fluidic interconnects 104 during one or both of shipping and storage of the fluid container 102. For example, the seal provided by the fluidic sealing members 112 may be a fluid tight seal that substantially prevents leakage of one or both of a liquid and a gas within the fluid container during shipping and storage. In some examples, the seal may provide a gas tight or hermetic seal that one or both of prevents air from an ambient environment from penetrating the fluid container 102 and retains a gas inside the fluid container 102, for example.

In some examples, a fluidic sealing member 112 of the elastomeric seal 110 comprises an elastomeric cap 112 having a base with a side surrounding the base at one end and a hollow interior. In particular, the three fluidic sealing members 112 illustrated in FIG. 1A are elastomeric caps 112. Elastomeric cap 112 is sized to form a fluid tight seal to a nozzle 108 of the fluid interconnect 104 of the fluid container 102, according to some examples. For example, the fluid tight seal may be formed at an inner surface of the elastomeric cap 112. The fluid tight seal may be provided by a contact between an outer surface of the nozzle 108 and the inner surface of the elastomeric cap 112, for example.

Figure 2A:
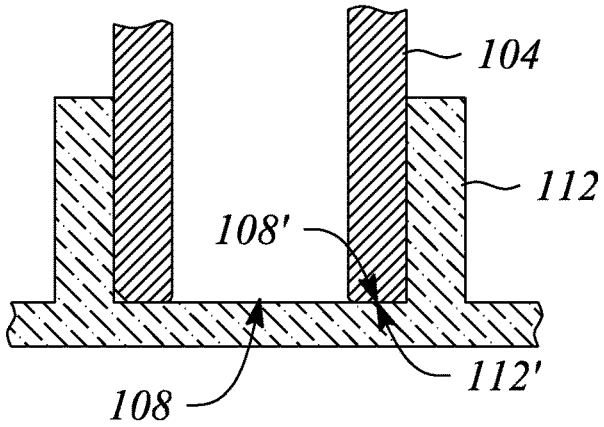
FIG. 2A illustrates a cross sectional view of an elastomeric cap, according to an example consistent with the principles described herein.

FIG. 2A illustrates a cross sectional view of an elastomeric cap 112 of the elastomeric seal, according to an example consistent with the principles described herein. In particular, FIG. 2A illustrates the elastomeric cap 112 interfaced to and sealing the nozzle 108 of a fluidic interconnect 104. A seal is illustrated between a rim 108' of the nozzle 108 and a ring-shaped portion of the inner surface corresponding to the rim 108'. A positive contact may compress the inner surface of the elastomeric cap 112 to provide the seal with the rim 108', according to some examples.

In other examples, a fluidic sealing member 112 of the elastomeric seal 110 may comprise another shape or configuration other than that of a cap (e.g., that fits over the nozzle 108 of the fluid interconnect 104. For example, the fluidic sealing member 112 may comprise an elastomeric plug configured to fit into an orifice. For example, the orifice may be an opening at an end of the nozzle 108. In another example (not illustrated), the orifice may be a hole in a surface of the fluid container 102 that serves as the fluid interconnect, for example. In another example, the fluidic sealing member 112 may comprise a substantially flat elastomeric sheet or film (e.g., a gasket) that is configured to cover the fluid interconnect (i.e., an opening or orifice thereof). The elastomeric sheet may be held against the fluid interconnect by a backing member to provide the seal, for example.

Figure 2B:
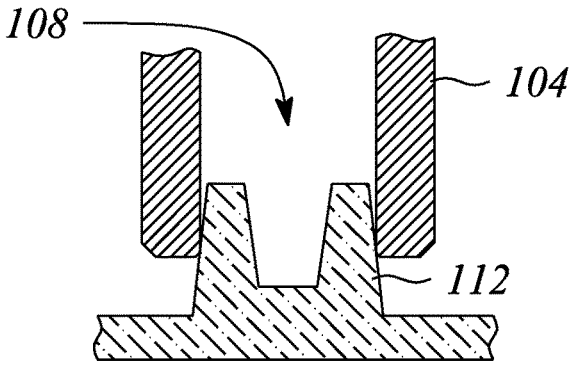
FIG. 2B illustrates a cross sectional view of a fluidic sealing member comprising an elastomeric plug, according to an example consistent with the principles described herein.

FIG. 2B illustrates a fluidic sealing member 112 comprising an elastomeric plug 112, according to an example consistent with the principles described herein. In this example, the nozzle 108 of the fluid interconnect 104 of FIG. 1B is also illustrated in FIG. 2B. As illustrated, the elastomeric plug 112 fits into an end of the nozzle 108 to provide the seal in much the same manner as a cork seals a bottle or a rubber stopper plugs the mouth of a flask.

Figure 2C:
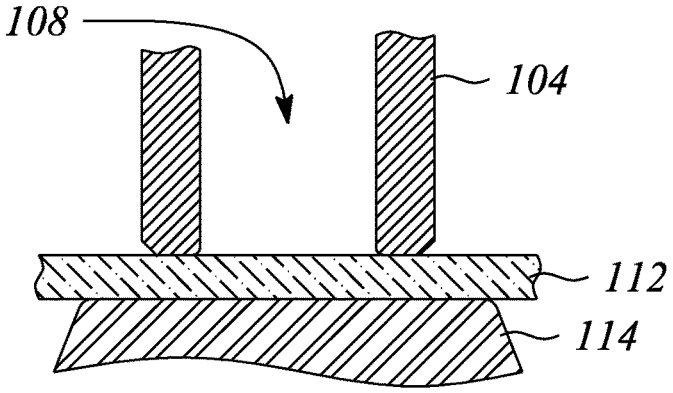
FIG. 2C illustrates a cross sectional view of a fluidic sealing member comprising an elastomeric sheet, according to an example consistent with the principles described herein.

FIG. 2C illustrates a cross sectional view of a fluidic sealing member 112 comprising an elastomeric sheet 112, according to an example consistent with the principles described herein. As illustrated in FIG. 2C, the elastomeric sheet 112 seals the end of the nozzle 108 of the fluid interconnect 104 of FIG. 1B, by way of example. In another example, the elastomeric sheet 112 may seal an orifice or hole in a surface of a fluid container (e.g., that lacks a nozzle). In some examples, the seal may be facilitated by a backing member 114 (e.g., a pressure plate) that provides positive contact between the elastomeric sheet 112 and the end of the nozzle 108 or a surface surrounding the orifice, for example. The positive contact may result in the elastomeric sheet 112 acting as a gasket, for example. In some examples, the backing member 114 may be part of the rigid shell, described below.

According to various examples, the elastomeric seal 110 comprises an elastomeric material configured to provide sufficient flexure when in positive contact with a mating surface (e.g., the fluid interconnect 104). The flexure allows the elastomeric seal 110 to seat against and establish the seal with the mating surface. In particular, the elastomeric material is configured to enable formation of a reliable fluid tight seal with application of a moderate compression force to the elastomeric seal 110 (e.g., less than about 50 newtons). In some examples, the elastomeric seal 110 comprises an elastomeric material with a Shore A durometer ranging from about 30 to about 35.

In some examples, the elastomeric material comprises a thermoplastic vulcanizate. For example, the elastomeric material may comprise Santoprene brand thermoplastic vulcanizate. Santoprene is a product of ExxonMobil of Irving, Tex., USA. In other examples, the elastomeric material may comprise another flexible rubber or rubber-like material suitable for forming a seal including, but not limited to, silicone, polyurethane, nitrile (e.g., BUNA-N), ethylene propylene, fluorosilicone, neoprene, and natural rubber.

Referring again to FIGS. 1A and 1B, the fluid container ship cap 100 further comprises a rigid shell 120. The rigid shell 120 comprises a handle 122 configured to rotate the fluid container ship cap 100 about the axis of rotation 106, according to some examples. In particular, a torque applied to the handle 122 (e.g., by pressing the handle 122) may result in a rotation of the rigid shell 120 about the axis of rotation 106. The applied torque may be in a plane substantially parallel to a plane of the rotation (i.e., perpendicular to the rotational axis), for example. The handle 122 may be or may serve as a lever arm, for example. As illustrated in FIG. 1A, the handle 122 comprises a lever arm that extends radially from the rigid shell. The torque may be applied by pressing on the handle 112 with a finger, for example. In another example (not illustrated), the handle 122 may comprise a fin or blade-like structure that extends vertically from a top of the rigid shell 120. The fin is configured to allow the application of the torque (e.g., by grasping the fin between a thumb and a finger) to rotate the fluid container ship cap 100, for example.

In yet other examples (not illustrated), the rigid shell 120 does not include a handle 122. For example, the torque may be applied by grasping an edge or edges of the rigid shell 120. In some examples, the rigid shell 120 may include features instead of or in addition to the handle 122 to facilitate rotation of the fluid container ship cap 100. For example, the edge(s) may be provided with various projections, with friction surfaces (e.g., knurled), or with indents to assist in grasping and moving the rigid shell 120 with respect to the fluid container 102.

In some examples, the axis of rotation 106 is at a fulcrum provided by a first fluidic sealing member 112 of the plurality of fluidic sealing members 112. For example, as illustrated in FIG. 1A, the elastomeric seal 100 comprises three fluidic sealing members 112. The first fluid sealing member 112 may be a middle or center one of the three fluidic sealing members 112 and the axis of rotation 106 may be at a fulcrum provided by the middle fluidic sealing member 112, as illustrated in FIG. 1A. In other examples (not illustrated), the axis of rotation 106 may be at a fulcrum provided by another fluidic sealing member 112 of the plurality other than the middle fluidic sealing member 112. For example, a fluidic sealing member 112 on either side of the middle fluidic sealing member 112 may provide the fulcrum. In some examples, the fulcrum may further include a first fluidic interconnect 104 corresponding to the first fluidic sealing member 112. For example, the first fluidic interconnect 104 may comprise a middle one of the three fluidic interconnects 104 illustrated in FIG. 1B (i.e., delineated by the axis of rotation 106).

According to various examples, the elastomeric seal 110 is affixed to the rigid shell 120 to provide a connection between the rigid shell 120 and the elastomeric seal 110. The connection enables the rigid shell 120 and elastomeric seal 110 to remain together even when the separated from the fluid container 102, for example. In particular, when the fluid container ship cap 100 is removed from the fluid container 100 by lifting on the rigid shell 120, for example, the elastomeric seal 110 is configured to remain substantially attached to the rigid shell 120. As such, separating the rigid shell 120 from the fluid container 102 also separates the elastomeric seal 110 from the fluid container 102, according to various examples.

In some examples, the elastomeric seal 110 is affixed to the rigid shell 120 at the first fluidic sealing member 112. In other words, the elastomeric seal 110 and the rigid shell 120 are connected to one another at or in a vicinity of the fulcrum. Portions of the elastomeric seal 110 including other fluidic sealing members 112 that are connected to the first fluidic sealing member 112 may be substantially free of attachment to the rigid shell 120, according to some examples. For example, portions of the elastomeric seal 110 located laterally away from the first fluidic sealing member 112 at the fulcrum may be free to flex or rotate separately from the rigid shell 120 when the rigid shell 120 is rotated. In some examples, a fluidic sealing member 112 located laterally away from the fulcrum may be configured to deform during the rotation.

In other examples, the elastomeric seal 110 is affixed to the rigid shell 120 at more points than at the first fluidic sealing member 112. For example, the elastomeric seal 110 may be affixed to the rigid shell 120 along a substantial length of the elastomeric seal 110. By 'substantial length' it is meant, e.g., an entire length thereof, or an amount ranging from the entire length to more than just the length of the first fluidic sealing member. As such, the elastomeric seal 110 rotates substantially in concert with the rigid shell 120 when the rigid shell 120 is rotated by a torque applied to the handle 122.

Figure 3A:
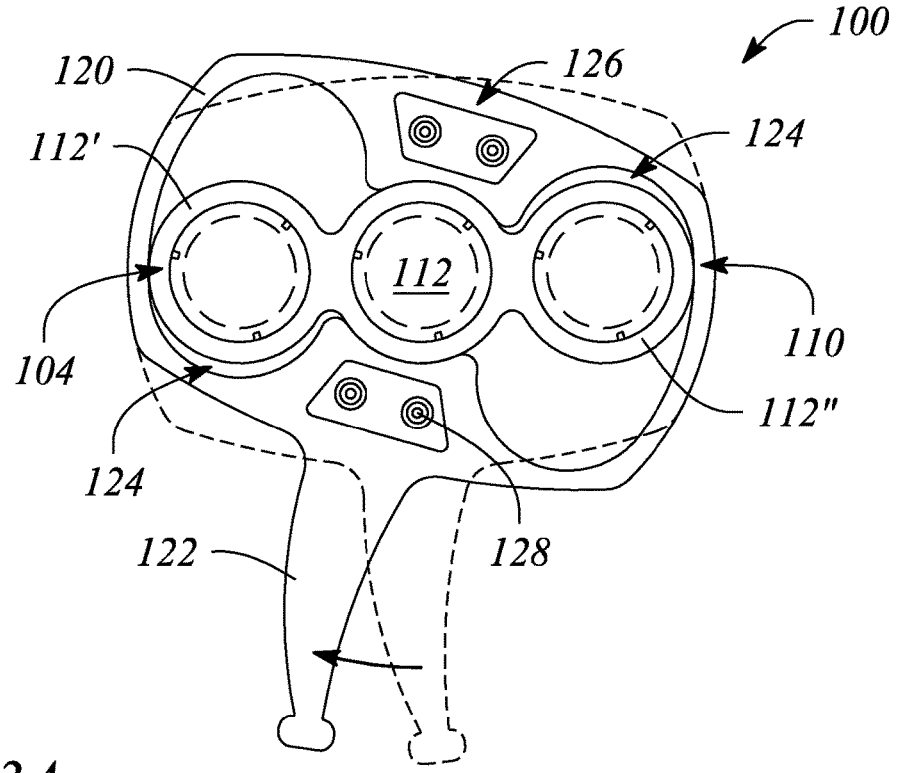
FIG. 3A illustrates rotation of the fluid container ship cap of FIG. 1A in plan view, according to an example consistent with the principles described herein.
Figure 3B:
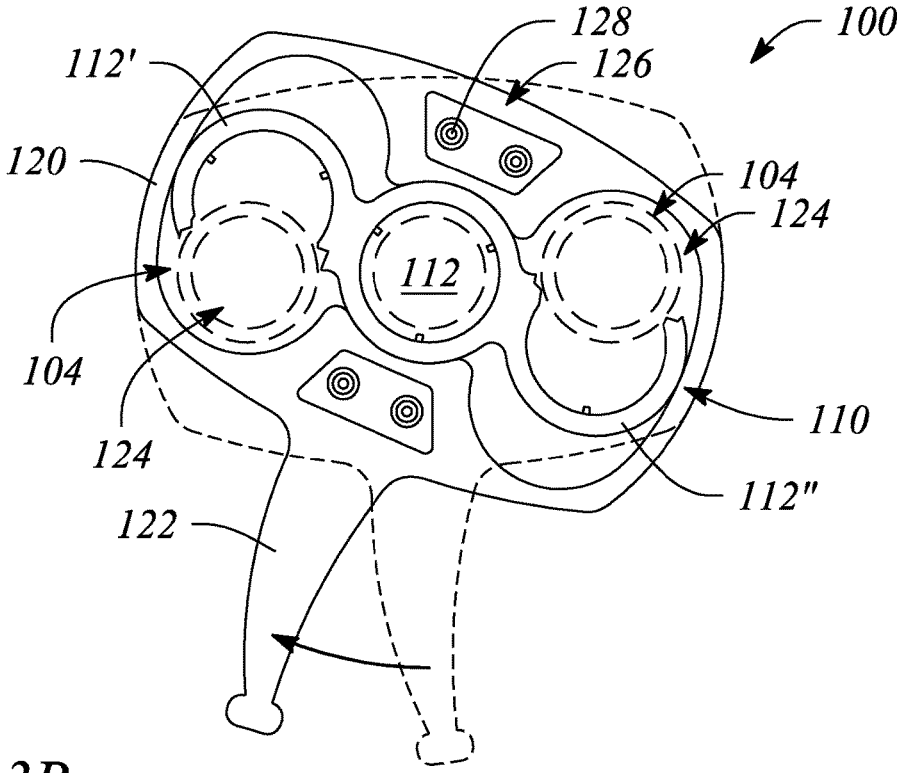
FIG. 3B illustrates rotation of the fluid container ship cap of FIG. 1A in plan view, according to another example consistent with the principles described herein.

FIG. 3A illustrates a rotation of the fluid container ship cap 100 of FIG. 1A, according to an example consistent with the principles described herein. FIG. 3B illustrates a rotation of the fluid container ship cap 100 of FIG. 1A, according to another example consistent with the principles described herein. In particular, FIG. 3A illustrates the fluid container ship cap 100 during rotation where the elastomeric seal 110 is affixed to the rigid shell 120 at only the first sealing member 112. FIG. 3B illustrates the fluid container ship cap 100 during rotation where the elastomeric seal 110 is affixed to the rigid shell 120 along a substantial length, e.g., the entire length, of the elastomeric seal 110. Rotation is illustrated in FIGS. 3A and 3B by a curved arrow at the handle 122 and the rotation is around the axis of rotation (e.g., rotational axis 106 illustrated in FIG. 1A) located at the first fluidic sealing member 112 (e.g., the middle one of three, as illustrated). A dashed outline in FIGS. 3A and 3B illustrates a starting position of the fluid container ship cap 100, prior to the illustrated rotation. Views illustrated in FIGS. 3A and 3B are plan views of the mating side of the fluid container ship cap 100.

As illustrated in FIG. 3A, the elastomeric seal 110 remains substantially fixed in place and rotates along with the rigid shell 120 at the first fluidic sealing member 112 during the rotation about the rotational axis. However, a second fluidic sealing member 112' and a third fluidic sealing member 112" that are laterally displaced from the first fluidic sealing member 112 are not affixed to the rigid shell 120, as illustrated in FIG. 3A. Hence, as the rigid shell 120 rotates, the second and third fluidic sealing members 112', 112" do not rotate with the rigid shell 120.

For example, the second and third fluidic sealing members 112', 112" may be substantially prevented from rotating by corresponding second and third fluid interconnects 104 (illustrated as dashed rings within the sealing members 112', 112" in FIG. 3A). During rotation, the second and third fluidic sealing member 112', 112" may remain in a position corresponding to before the rotation as dictated by the locations of the second and third fluid interconnects 104, for example. In particular, rotation may deform the elastomeric seal 110 (e.g., as the first fluidic sealing member 112 rotates and the second and third fluidic sealing members 112', 112" do not), for example. In some examples, the fluidic sealing members 112 located laterally away from the fulcrum or axis of rotation may ultimately deform as a result of being constrained to not rotate with the rigid shell 120 and first fluidic sealing member 112. The deformation may facilitate disengagement of the fluidic sealing members 112 from the fluid interconnects, for example.

FIG. 3B illustrates the elastomeric seal 110 rotates substantially in concert with the rigid shell 120 during the rotation about the rotational axis. If the second and third fluidic sealing members 112', 112", located laterally away from the first fluidic sealing member 112 at the rotational axis are connected to fluid interconnects of a fluid container, the second and third fluidic sealing members 112', 112" may one or both of deform and tear during the rotation to disengage from the fluid interconnects. For example, as illustrated in FIG. 3B, the second and third fluidic sealing members 112', 112" may comprise weak points (e.g., molded grooves). The weak points are configured to tear as the fluid container ship cap 100 is rotated. The tear breaks the connection between the fluid interconnects and the second and third fluidic sealing members 112', 112" during rotation, according to some examples. In other examples (not illustrated), the fluidic sealing members 112 located laterally away from the first fluidic sealing member 112 may simply deform to disengage from the fluid interconnects during rotation.

Referring back to FIG. 1A, in some examples, the rigid shell 120 further comprises a cavity 124 in a surface (e.g., a surface of the mating side) of the rigid shell 120. In these examples, the elastomeric seal 110 may be affixed in the cavity 124, as illustrated. In some examples, the cavity 124 may provide a void adjacent to one or both of the second and third fluidic sealing members 112', 112" located laterally away from the first fluidic sealing member 112. The void may facilitate rotation of the fluid container ship cap 100, according to some examples. In particular, the void may provide clearance for a fluid interconnect 104 associated with one or both of the second and third fluidic sealing members 112', 112" during rotation.

For example, when the elastomeric seal 110 is affixed to the cavity at the first fluidic sealing member 112, the void may accommodate or provide clearance for the fluidic sealing members 112 and the engaged fluid interconnects 104 during rotation. FIG. 3A illustrates the cavity 124 and the void accommodating the elastomeric seal 110 during rotation, for example. Alternatively, as illustrated in FIG. 3B, when the elastomeric seal 110 is affixed to the cavity along a substantial length of elastomeric seal 110, the void may provide clearance for the fluid interconnects 104 as the corresponding fluidic sealing members 112 (e.g., the second and third fluidic sealing members 112', 112") disengage (e.g., tear or deform) from the fluid interconnects 104.

Referring again to FIG. 1A (also illustrated in FIG. 3A-3B), the rigid shell 120 further comprises an attachment area 126, according to some examples. The attachment area 126 is configured to affix the fluid container ship cap 100 to the fluid container 102 (e.g., illustrated in FIG. 1B). In particular, the attachment area 126 is configured to provide a location for a severable attachment of the fluid container ship cap 100 to the fluid container 102. The attachment area 126 is further configured to maintain a positive contact between the fluidic sealing members 112 and the corresponding fluid interconnects 104. In other words, the attachment area 126 facilitates sealing the fluid container 102 with the fluid container ship cap 100. Further, the attachment area 126 facilitates removal of the fluid container ship cap 100 through the attachment being severable.

In some examples, the severable attachment provided in the attachment area 126 comprises weld points 128 configured to bridge between the rigid shell 120 and the fluid container 102. The weld points 128 may be ultrasonic weld points formed from a material of one or both of the rigid shell 120 and the fluid container 102, for example. In another example, the severable attachment provided in the attachment area 126 may comprise a small quantity of epoxy or similar glue-like material that bridges between the rigid shell 120 and the fluid container 102. The weld points 128 or small quantity of epoxy is sized or configured to be sufficiently strong to retain the fluid container ship cap 100 on the fluid contain 102 during shipping and storage, but weak enough to facilitate severing by rotation of the fluid container ship cap 100 for removal thereof. In yet other examples, the severable attachment provided by the attachment area 126 comprises another attachment mechanism including, but not limited to, a strap (e.g., foil tape) that runs from the rigid shell 120 to the fluid container 102. The strap may be readily torn or broken by the rotation to remove the fluid container ship cap 100, for example.

According to various examples, the rigid shell 120 comprises a rigid polymer material. For example, the rigid polymer material may comprise polyurethane. In other examples, the rigid polymer material may include, but is not limited to, various polyureas, polyisocyanurate, polyester, polyphenol, polyepoxide, high-density polyethylene (HDPE), polypropylene (PP), polyvinyl chloride (PVC), polystyrene (PS), acrylonitrile butadiene styrene (ABS), polyoxymethylene (POM), polycarbonates (PC), polyethylene terephthalate (PET), polyurethane (PU) and nylon 6, for example. In some examples, the rigid polymer may be selected based on suitability for molding (e.g., injection molding). For example, the fluid container ship cap 100 may be fabricated using a 'two-shot' molding process in which the rigid shell 120 is molded first and then the elastomeric seal 110 is molded into the rigid shell 120. In yet other examples, the rigid shell 120 may comprise a substantially non-polymer material. For example, the rigid shell 120 may comprise a metal such as, but not limited to, aluminum, steel as well as various alloys thereof. The metal may be stamped or machined to form the rigid shell 120, for example. In yet other examples, the rigid shell 120 may comprise other rigid materials including, but not limited to, ceramics, cellulose (e.g., paper, wood) and various composite materials.

Figure 4:
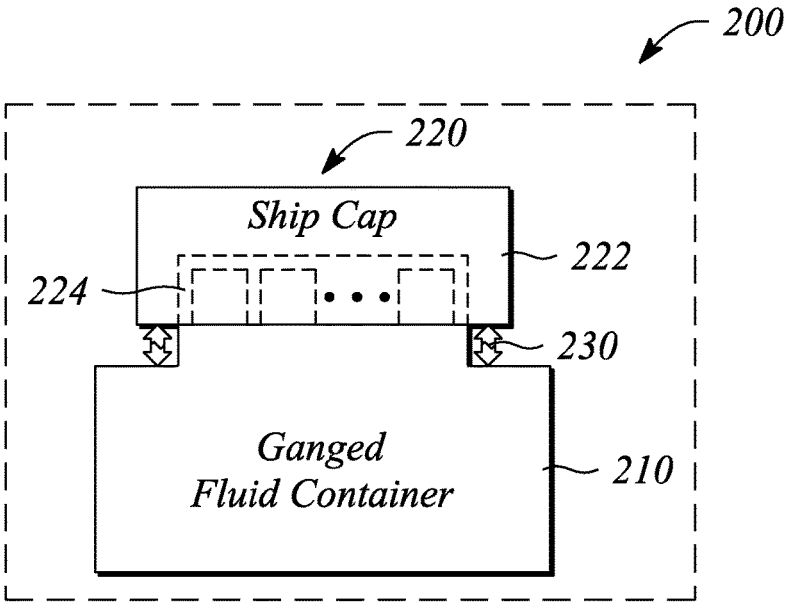
FIG. 4 illustrates a block diagram of a ganged fluid reservoir assembly, according to an example consistent with the principles described herein.

FIG. 4 illustrates a block diagram of a ganged fluid reservoir assembly 200, according to an example consistent with the principles described herein. As illustrated, the ganged fluid reservoir assembly 200 comprises a ganged fluid container 210. For example, the ganged fluid container 210 may have reservoirs ganged together to separately hold fluids, each fluid being a different color ink, for example. The reservoirs have separate fluid interconnects (e.g., fluid outlets to separately dispense the fluids). In some examples, the ganged fluid reservoir 210 may be substantially similar to the fluid reservoir 102 described above with respect to the fluid container ship cap 100.

As illustrated in FIG. 4, the ganged fluid reservoir assembly 200 further comprises a ship cap 220. The ship cap 220 is configured to seal the ganged fluid container 210, according to various examples. The ship cap 220 is configured to seal the ganged fluid container 210 during one or both of shipping and storage, for example. For example the ship cap 220 may be removed from the ganged fluid container 210 before a first time installation of the ganged fluid container 210 (e.g., in a printer). In some examples, a packaging, seal, wrap, box or the like may be provided around the ganged fluid reservoir assembly 200, for example, during shipping, storage, etc. FIG. 4 illustrates disposable packaging around the ganged fluid reservoir assembly 200 as a dashed line. In some examples, the ship cap 220 and packaging are separately disposable. In some examples, the ship cap 220 is substantially similar to the fluid container ship cap 100 described above. In particular, the ship cap 220 comprises a rigid shell 222 and an elastomeric seal 224 affixed to the rigid shell 222.

According to various examples, the elastomeric seal 224 comprises a plurality of fluidic sealing members to separately provide fluid tight seals to the fluid interconnects of the ganged fluid container 210. In some examples, the elastomeric seal 224 is substantially similar to the elastomeric seal 110 described above with respect to the fluid container ship cap 100. According to some examples, the rigid shell 222 may comprise a handle to facilitate rotation of the ship cap 220. In particular, the handle may facilitate rotation of the ship cap 220 about a fulcrum (e.g., an axis of rotation associated with a fluidic sealing member) corresponding to a fluid interconnect of the reservoir fluid interconnects of the ganged fluid container 210. In some examples, the rigid shell 222 and handle may be substantially similar to respective ones of the rigid shell 120 and the handle 122, described above. In other examples, the rigid shell 222 may be without a handle. Rotation of the ship cap 220 about the fulcrum may be achieved by grasping an edge (e.g., a knurled edge) of the rigid shell 222, for example.

The rotation about the fulcrum facilitates removal of the ship cap 220 from the ganged fluid container 210, according to various examples. The ship cap 220 may be removed to place the ganged fluid container 210 into operation, for example. In some examples, the rotation of the rigid shell 222 is configured to sever an attachment between the ship cap 220 and the ganged fluid container 210 to facilitate ship cap removal.

In some examples, the rigid shell 222 comprises a cavity in surface of the rigid shell 222 adjacent to the ganged fluid container 210. In some examples, the elastomeric seal 224 is affixed in the cavity at a location corresponding to the rotational axis at the fulcrum. In some examples, the elastomeric seal 224 is also affixed to the cavity along a length of the elastomeric seal 224. In some examples, the cavity is substantially similar to the cavity 124 described above with respect to the fluid container ship cap 100. In some examples, a fluidic sealing member of the elastomeric seal 224 located laterally away from the fulcrum one or both of deforms and tears during the rotation of the ship cap 220 to further facilitate removal of thereof.

In some examples, the ganged fluid reservoir assembly 200 further comprises a plurality of severable attachment points 230 between the ganged fluid container 210 and the ship cap 220. According to various examples, the severable attachment points 230 are configured to provide an attachment between the ganged fluid container 210 and the ship cap 220. In particular, the severable attachment points 230 are configured to maintain a positive contact between the fluidic sealing members of the elastomeric seal 224 and the fluid interconnects of the reservoirs. In some examples, the severable attachment points 230 are configured to break with the rotation of the rigid shell 222 to release the fluidic sealing member from the fluid interconnects facilitating removal of the ship cap. In some examples, the plurality of severable attachment points 230 is substantially similar to the attachment area 126 comprising locations for attachment points 128, as described above for the fluid container ship cap 100.

In some examples, the ganged fluid container 210 of the ganged fluid reservoir assembly 200 is a ganged ink supply. For example, the ganged fluid container 210 may be a ganged ink supply for an inkjet printer. The fluids in the ganged together reservoirs may comprise a plurality of different color inks for use by the inkjet printer, for example.

Figure 5:
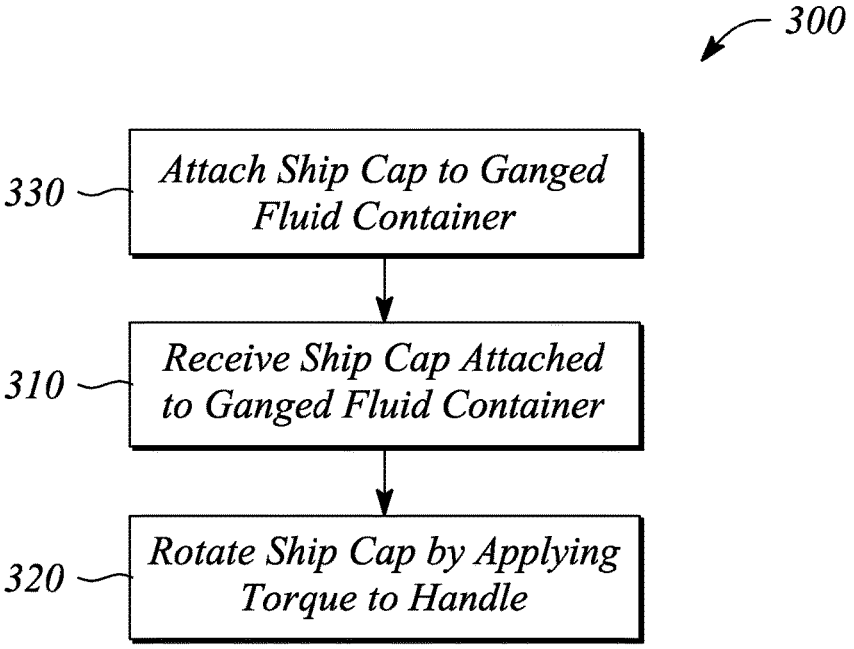
FIG. 5 illustrates a flow chart of a method of using a fluid container ship cap, according to an example consistent with the principles described herein.

FIG. 5 illustrates a flow chart of a method 300 of using a fluid container ship cap, according to an example consistent with the principles described herein. As illustrated, the method 300 of using a fluid container ship cap comprises receiving 310 a ship cap attached to a ganged fluid container. In various examples, the received 310 ship cap may be substantially similar to the fluid container ship cap 100, described above. In some examples, the received 310 ship cap attached to a ganged fluid container may be substantially similar to the ganged fluid reservoir assembly 200, described above. In particular, the received 310 ship cap may comprise an elastomeric seal having a plurality of fluidic sealing members and a rigid shell. In some examples, the rigid shell may have a handle while in other examples the rigid shell may be without a handle. In some examples, the rigid shell may comprise other features instead of or in addition to the handle (e.g., to assist in grasping the rigid shell).

In some examples, the elastomeric seal and the fluidic sealing members of the received 310 ship cap are substantially similar to the elastomeric seal 110 and the fluidic sealing members 112, respectively. Similarly, the rigid shell and separately the handle of the received 310 ship cap may be substantially similar to respective ones of the rigid shell 120 and the handle 122, in some examples. In some examples, the elastomeric seal is affixed to the rigid shell. The elastomeric seal affixed to the rigid shell may provide a fluid tight seal at a plurality of fluid interconnects of the ganged fluid container using the fluidic sealing members, according to various examples.

The method 300 of using a fluid container ship cap further comprises rotating 320 the ship cap by applying a torque to the rigid shell using the handle. Rotating 320 the ship cap may break a severable attachment between the rigid shell and the ganged fluid container, according to various examples. In some examples, the rotation 320 is about a rotational axis at a fulcrum corresponding to a fluidic sealing member of the plurality. According to various examples, a fluidic sealing member at one ore more of the fluid interconnects located laterally away from the fulcrum either tears or deforms to break the fluid tight seal during rotating 320.

In some examples, the method 300 further comprises attaching 330 the ship cap to the ganged fluid container. In some examples, attaching 330 comprises creating severable attachments between the ship cap and the ganged fluid container in an attachment area of the rigid shell. For example, the severable attachments may be created using a plurality of ultrasonic weld points. Rotating 320 the ship cap about the rotational axis (e.g., by pushing on the handle) breaks the ultrasonic weld points. In other examples, attaching 330 may employ any of a variety of other attachments methods configured to be broken by rotating 320 the ship cap. Other attachments may include, but are not limited to, weld points other than ultrasonic weld points, a small amount of epoxy or another adhesive material, and a strap between the ship cap and the ganged fluid container that are severable by rotating 320 the ship cap.

Thus, there have been described examples of a fluid container ship cap, a ganged fluid container assembly and a method of using a fluid container ship cap that employ an elastomeric seal having a plurality of fluidic sealing members affixed to a rigid shell having a handle. It should be understood that the above-described examples are merely illustrative of some of the many specific examples that represent the principles described herein. Clearly, those skilled in the art can readily devise numerous other arrangements without departing from the scope as defined by the following claims.

What is claimed is:

1. A fluid container ship cap comprising:

an elastomeric seal comprising a plurality of fluidic sealing members to seal a corresponding plurality of fluid interconnects of a fluid container; and a rigid shell comprising a handle, under the action of an external torque, to rotate the fluid container ship cap about a rotational axis at a fulcrum provided by a first fluidic sealing member of the plurality of fluidic sealing members, the elastomeric seal being affixed to the rigid shell, wherein the handle extends radially from the rigid shell at the fulcrum in a plane substantially parallel to the plane of rotation, wherein at least one second fluidic sealing member of the plurality of fluidic sealing members is located laterally away from the fulcrum to deform and tear during rotation of the fluid container ship cap so as to disengage the fluidic sealing members from a corresponding fluid interconnect.

2. The fluid container ship cap of claim 1, wherein a fluidic sealing member of the elastomeric seal comprises an elastomeric cap, the elastomeric cap being sized to form a fluid tight seal to a nozzle of the fluid interconnect of the fluid container at an inner surface of the elastomeric cap.

3. The fluid container ship cap of claim 1, wherein the at least one second fluidic sealing member comprises molded grooves.

4. The fluid container ship cap of claim 1, wherein the rigid shell further comprises a cavity in a surface of the rigid shell, the elastomeric seal being affixed in the cavity and the cavity providing a void adjacent to the at least one second fluidic sealing member located laterally away from first fluidic sealing member to facilitate rotation of the fluid container ship cap.

5. The fluid container ship cap of claim 4, wherein the elastomeric seal is affixed in the cavity at the first fluidic sealing member, the void to accommodate the elastomeric seal with rotation of the fluid container ship cap about the rotational axis.

6. The fluid container ship cap of claim 1, wherein the rigid shell further comprises an attachment area to affix the fluid container ship cap to the fluid container, the attachment area to provide a severable attachment to the fluid container and to maintain a positive contact between the fluidic sealing members of the elastomeric seal and the corresponding fluid interconnects.

7. The fluid container ship cap of claim 6, wherein the severable attachment comprises weld points to bridge between the rigid shell and the fluid container, the rotation of the fluid container ship cap to sever the weld points.

8. The fluid container ship cap of claim 1, wherein the fluidic sealing members comprises a thermoplastic vulcanizate, and wherein the rigid shell comprises a rigid polymer.

9. A ganged inkjet ink reservoir assembly comprising:

a ganged fluid container having reservoirs ganged together to separately hold fluids, the reservoirs having separate fluid interconnects; and a fluid container ship cap to seal the ganged fluid container, the fluid container ship cap comprising a rigid shell having a handle, and an elastomeric seal affixed to the rigid shell, the elastomeric seal comprising a plurality of fluidic sealing members to separately provide fluid tight seals to the fluid interconnects, the handle, under the action of an external torque, to facilitate rotation of the fluid container ship cap about a fulcrum corresponding to a first fluidic sealing member of the plurality of fluidic sealing members, wherein the handle extends radially from the rigid shell at the fulcrum in a plane substantially parallel to the plane of rotation, wherein at least one second fluidic sealing member of the plurality of fluidic sealing members is located laterally away from the fulcrum to deform and tear during rotation of the fluid container ship cap so as to disengage the fluidic sealing members from a corresponding fluid interconnect.

10. The ganged inkjet ink reservoir assembly of claim 9, wherein the rigid shell has a cavity in a surface of the rigid shell adjacent to the ganged fluid container, the elastomeric seal being affixed in the cavity at a location corresponding to a rotational axis at the fulcrum.

11. The ganged inkjet ink reservoir assembly of claim 9, further comprising a plurality of severable attachment points between the ganged fluid container and the fluid container ship cap, the severable attachment points to provide the attachment between the ganged fluid container and the fluid container ship cap and to maintain a positive contact between the fluidic sealing members of the elastomeric seal and the fluid interconnects of the reservoirs, wherein the severable attachment points are to break with the rotation of the rigid shell to release the fluidic sealing members from the fluid interconnects.

12. The ganged inkjet ink reservoir assembly of claim 9, wherein the fluidic sealing members comprises a thermoplastic vulcanizate, and wherein the rigid shell comprises a rigid polymer.

13. A method of using a fluid container ship cap, the method comprising:

receiving the fluid container ship cap attached to a ganged fluid container, the fluid container ship cap comprising an elastomeric seal having a plurality of fluidic sealing members and a rigid shell having a handle, wherein the elastomeric seal is affixed to the rigid shell and provides a fluid tight seal at a plurality of fluid interconnects of the ganged fluid container using the fluidic sealing members; and rotating the fluid container ship cap by applying an external torque to the handle and consequently to the rigid shell the rotation being about a rotational axis at a fulcrum corresponding to a first fluidic sealing member of the plurality of fluidic sealing members, wherein the handle extends radially from the rigid shell at the fulcrum in a plane substantially parallel to the plane of rotation, wherein at least one second fluidic sealing member of the plurality of fluidic sealing members is located laterally away from the fulcrum to deform and tear during rotation of the fluid container ship cap to disengage the fluidic sealing members from a corresponding fluid interconnect.

14. The method of using a fluid container ship cap of claim 13, further comprising attaching the ship cap to the ganged fluid container using a plurality of weld points, wherein rotating the ship cap about the rotational axis breaks the ultrasonic weld points, and wherein the ganged fluid container is an inkjet ink reservoir.

* * * * *